US008783586B2

(12) United States Patent
Kashiwagi et al.

(10) Patent No.: US 8,783,586 B2
(45) Date of Patent: Jul. 22, 2014

(54) INJECTOR FOR INTERNAL COMBUSTION ENGINE

(75) Inventors: Daisuke Kashiwagi, Anjo (JP); Tomoyuki Tsuda, Mizuho (JP)

(73) Assignee: Denso Corporation, Kariya (JP)

( * ) Notice: Subject to any disclaimer, the term of this patent is extended or adjusted under 35 U.S.C. 154(b) by 223 days.

(21) Appl. No.: 13/415,130

(22) Filed: Mar. 8, 2012

(65) Prior Publication Data

US 2012/0228406 A1 Sep. 13, 2012

(30) Foreign Application Priority Data

Mar. 9, 2011 (JP) ..... 2011-51362

(51) Int. Cl.

| | |
|---|---|
| ***F02M 59/00*** | (2006.01) |
| ***F02M 61/00*** | (2006.01) |
| ***F02M 63/00*** | (2006.01) |
| ***B05B 1/30*** | (2006.01) |
| ***F02M 55/00*** | (2006.01) |
| ***F02M 55/02*** | (2006.01) |

(52) U.S. Cl.

CPC ..... *F02M 55/005* (2013.01); *F02M 55/008* (2013.01); *F02M 55/02* (2013.01)

USPC ..... 239/533.2; 239/583; 239/584; 285/332

(58) Field of Classification Search

CPC ... F02M 55/02; F02M 55/025; F02M 55/008; F02M 55/005; F02M 61/16; F16L 15/06

USPC ..... 239/533.2, 583, 584, 585.1; 285/332

See application file for complete search history.

(56) References Cited

U.S. PATENT DOCUMENTS

| | | | | |
|---|---|---|---|---|
| 3,159,350 | A * | 12/1964 | Mangold | 239/533.6 |
| 6,234,413 | B1 * | 5/2001 | Greaney | 239/533.2 |
| 6,916,048 | B2 * | 7/2005 | Ricco | 285/220 |
| 7,878,427 | B2 * | 2/2011 | Wengert | 239/533.2 |
| 8,226,016 | B2 | 7/2012 | Felton | |
| 2003/0080217 | A1 * | 5/2003 | Boecking | 239/533.2 |
| 2003/0141386 | A1 * | 7/2003 | Wagner et al. | 239/533.2 |
| 2008/0066719 | A1 * | 3/2008 | Ricco et al. | 123/445 |
| 2009/0166445 | A1 | 7/2009 | Felton | |

FOREIGN PATENT DOCUMENTS

| | | |
|---|---|---|
| JP | 59-123662 | 8/1984 |
| JP | 59-123667 | 8/1984 |
| JP | 2006-233858 | 9/2006 |
| JP | 2006-316741 | 11/2006 |

OTHER PUBLICATIONS

Office Action dated Dec. 23, 2013, issued in corresponding Chinese Application No. 201210061680.9 English translation only (5 pages).

* cited by examiner

*Primary Examiner* — Ryan Reis
(74) *Attorney, Agent, or Firm* — Nixon & Vanderhye PC

(57) ABSTRACT

A hole axis of a communication hole is placed at a location, which coincides with a translated location of a hole axis of a connector hole that is translated toward an axial distal end portion of a main body in an axial direction of the main body. In this way, with respect to a high pressure flow passage, which is bent by 90 degrees and extends through the connector hole, the communication hole and an axial flow passage, the amount of projection of a projecting portion at an inner side area of this bent, which is located on the inner side of the bent, is reduced.

14 Claims, 4 Drawing Sheets

39
36 (16)
44
35 (16)
01 (02)
03
04
47
ONE-HALF OF R39
L
R39
R36
2
43
40
02
34 (16)
34a
34b
34c
50
51
49
38
4
46
41
RADIALLY OUTER SIDE
RADIALLY INNER SIDE
RADIAL DIRECTION
REAR END
DISTAL END
AXIAL DIRECTION

INJECTOR FOR INTERNAL COMBUSTION ENGINE

CROSS REFERENCE TO RELATED APPLICATION

This application is based on and incorporates herein by reference Japanese Patent Application No. 2011-51362 filed on Mar. 9, 2011.

TECHNICAL FIELD

The present disclosure relates to an injector for an internal combustion engine.

BACKGROUND

A previously proposed injector, which injects fuel with a very high injection pressure of over 100 MPa, receives the fuel through an inlet connector (see, for example, Japanese Unexamined Patent Publication No. 2006-316741A).

Specifically, with reference to FIGS. 3 and 4, a previously proposed injector 100 includes a main body 102, an injection nozzle 103 and an inlet connector 101. The main body 102 receives fuel from a fuel supply source. The injection nozzle 103 is securely connected to an axial distal end portion of the main body 102 and injects the fuel upon receiving the fuel from the main body 102. The inlet connector 101 is securely connected to a lateral side of the main body 102 and forms a fuel receiving portion to supply the fuel to the main body 102. The inlet connector 101 is securely screwed into a cylinder head (not shown) of the internal combustion engine and is engaged with the main body 102 with an axial force generated by the screwing of the inlet connector 101 into the cylinder head, so that the inlet connector 101 is securely connected to the main body 102.

Here, the main body 102 includes a connector hole 105 and an axial flow passage 106. The connector hole 105 receives a distal end portion of the inlet connector 101. The axial flow passage 106 extends in parallel with an axial direction of the main body 102 and guides the fuel, which is received from the inlet connector 101, to the injection nozzle 103. The distal end portion of the inlet connector 101 forms a contact circle 108 to seal the fuel through circular contact of the distal end portion of the inlet connector 101 against a tapered hole surface 107, which forms the connector hole 105.

In the main body 102 of the injector 100, a communication hole 110, which is coaxial with the connector hole 105, is formed, and the connector hole 105 and the axial flow passage 106 are communicated with each other in a radial direction through the communication hole 110 rather than directly communicating the connector hole 105 and the axial flow passage 106 with each other by connecting the axial flow passage 106 to the connector hole 105.

Specifically, in the case where the connector hole 105 and the axial flow passage 106 are directly communicated with each other, a surface area of an intersection between the connector hole 105 and the axial flow passage 106 may become small to possibly cause formation of a flow restriction, and an acute projecting portion having a small wall thickness may be formed to possibly cause a reduction in a compression strength. Therefore, in the main body 102 of the injector 100, the connector hole 105 and the axial flow passage 106 are communicated with each other in the radial direction by the communication hole 110, which is coaxial with the connector hole 105.

However, due to the development in the increasing of the injection pressure in late years, it has been demanded to increase the compressive strength in a connecting and intersecting structure of the connector hole 105, the axial flow passage 106 and the communication hole 110 in the main body 102. Specifically, a stress, which is caused by an axial force generated by the screwing of the inlet connector 101, and a stress, which is caused by a pressure of the received fuel, tend to be concentrated at an intersection between the connector hole 105 and the communication hole 110, an intersection between the communication hole 110 and the axial flow passage 106, and adjacent areas around these intersections. Thereby, it has been demanded to improve the compressive strength.

Here, in view of a location of a space 112, which accommodates other devices, such as a solenoid valve 115, and a location of other fuel flow passages, the axial flow passage 106 is provided at a location, which is spaced from the axis of the main body 102 and is adjacent to a radially outer side of the main body 102. Therefore, the intersection between the connector hole 105 and the communication hole 110 and the intersection between the communication hole 110 and the axial flow passage 106 are concentrated in a narrow range, which is adjacent to the radially outer side of the main body 102.

Furthermore, an axis O6 of the connector hole 105 and of the communication hole 110 is perpendicular to an axis O5 of the axial flow passage 106. The connector hole 105 is formed as a tapered hole having a large diameter. Therefore, the fuel flow passage, which extends through the connector hole 105, the communication hole 110 and the axial flow passage 106 and is bent by 90 degrees, forms an acute projecting portion 113 at an inner side area of this bent located on an inner side of the bent.

As a result, even in the projecting portion 113, the stress is concentrated at a flow passage adjacent layer 114, which is located at a radially inner side part of the projecting portion 113 along the axial flow passage 106 and is narrow. Thus, in order to increase the injection pressure, it is required to alleviate the concentration of the stress at the flow passage adjacent layer 114.

SUMMARY

The present disclosure is made in view of the above disadvantages.

According to the present disclosure, there is provided an injector for an internal combustion engine. The injector includes a main body, an injection nozzle and an inlet connector. The main body receives fuel from a fuel supply source. The injection nozzle is securely connected to an axial distal end portion of the main body and injects the fuel upon receiving the fuel from the main body. The inlet connector is securely connected to a lateral side of the main body and forms a fuel receiving portion to supply the fuel to the main body. The main body includes a connector hole, an axial flow passage and a communication hole. The connector hole receives a distal end portion of the inlet connector. The axial flow passage extends in parallel with an axial direction of the main body and guides the fuel, which is received from the inlet connector, to the injection nozzle. The communication hole communicates between the connector hole and the axial flow passage in a radial direction of the main body. The distal end portion of the inlet connector forms a contact circle to seal the fuel through circular contact of the distal end portion of the inlet connector against a tapered hole surface, which forms the connector hole. A hole axis of the communication hole is placed at a location, which coincides with a translated location of a hole axis of the connector hole that is translated toward the axial distal end portion of the main body in the axial direction of the main body.

BRIEF DESCRIPTION OF THE DRAWINGS

The drawings described herein are for illustration purposes only and are not intended to limit the scope of the present disclosure in any way.

DETAILED DESCRIPTION

Figure 1:
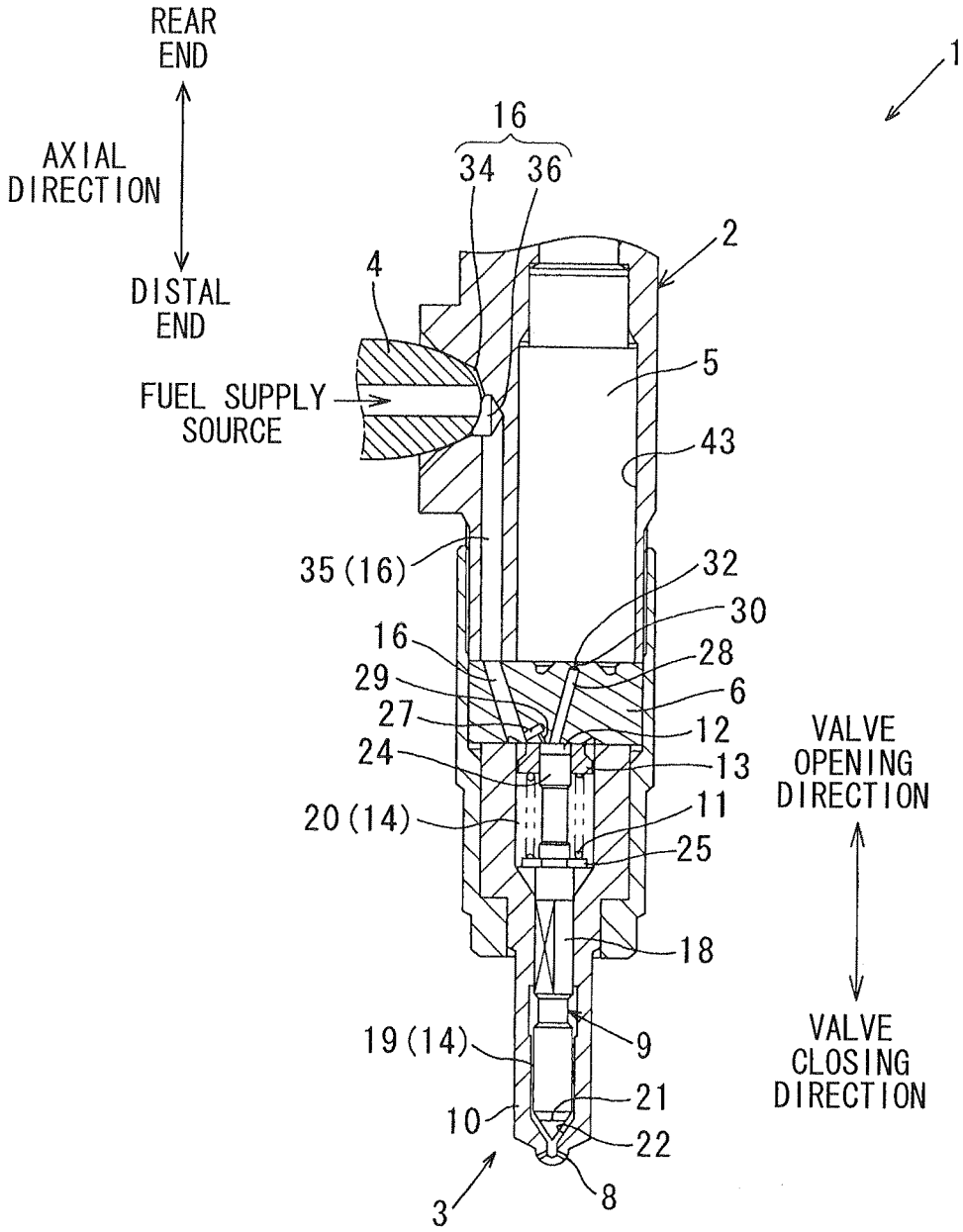
FIG. 1 is a diagram showing a structure of an injector according to an embodiment of the present disclosure.

A structure of an injector 1 according to an embodiment of the present disclosure will be described with reference to FIG. 1.

The injector 1 is adapted to inject fuel with an injection pressure that is a very high pressure of over 100 MPa. The injector 1 is installed to, for example, a diesel engine (not shown), which is an internal combustion engine, and directly injects fuel into a combustion chamber (not shown) of the diesel engine.

The injector 1 includes a main body 2, an injection nozzle 3, an inlet connector 4 and a solenoid valve 5. The main body 2 receives fuel from a fuel supply source. The injection nozzle 3 injects the fuel upon receiving the fuel from the main body 2. The inlet connector 4 forms a fuel receiving portion to supply the fuel to the main body 2. The solenoid valve 5 functions as an actuator that opens the injection nozzle 3. The injection nozzle 3 is securely connected to the axial distal end portion of the main body 2 through a tip packing 6 while the solenoid valve 5 is received in the main body 2, thereby forming the injector 1.

In the following discussion, the term "axial direction" refers to an axial direction of the injector 1 unless otherwise specified. The main body 2 and the injection nozzle 3 are coaxial with each other. Furthermore, an axis of the injector 1, an axis O1 of the main body 2 and an axis of the injection nozzle 3 coincide with each other.

The injection nozzle 3 includes a nozzle needle 9, a nozzle body 10, a coil spring 11 and a tubular member 13. The nozzle needle 9 is axially movable to open or close an injection hole 8. The nozzle body 10 axially slidably receives and supports the nozzle needle 9. The coil spring 11 urges the nozzle needle 9 in a closing direction (hereinafter referred to as a valve closing direction) for closing the injection hole 8. The tubular member 13 forms a back pressure chamber 12 to exert a fuel pressure against the nozzle needle 9 in the valve closing direction. The nozzle body 10 includes a cylinder 14, which is configured into a cylindrical tubular form and opens at an axial rear end of the cylinder 14. The nozzle needle 9 is slidably received and supported in the cylinder 14.

By securely connecting the main body 2 and the injection nozzle 3 together through the tip packing 6, the cylinder 14 is communicated with a high pressure flow passage 16 formed in the main body 2 and the tip packing 6 to supply high pressure fuel from the high pressure flow passage 16 to the cylinder 14.

The high pressure flow passage 16 refers to a flow passage, through which the high pressure fuel received from the fuel supply source flows without passing through any of various clearances and without causing a substantial reduction in the pressure of the high pressure fuel.

A middle portion of the nozzle needle 9 forms a slidable shaft portion 18, which is slidably supported in the nozzle body 10. A nozzle chamber 19 is formed on a distal end side of the slidable shaft portion 18 to exert the fuel pressure against the nozzle needle 9 in an opening direction (hereinafter referred to as a valve opening direction) for opening the injection hole 8. A spring chamber 20 is formed on a rear end side of the slidable shaft portion 18 to receive the coil spring 11. High pressure fuel is supplied from the high pressure flow passage 16 into the spring chamber 20. A portion of an outer peripheral surface of the slidable shaft portion 18 is chamfered to establish communication between the nozzle chamber 19 and the spring chamber 20 and to guide the high pressure fuel to the nozzle chamber 19.

A seat surface 22, against which a circular seatable portion 21 formed at a distal end portion of the nozzle needle 9 is seatable, is formed at a distal end portion of the cylinder 14. The injection hole 8 opens to the cylinder 14 at a location, which is on a distal end side (lower side in FIG. 1) of the seat surface 22 in the axial direction. Therefore, when the seatable portion 21 is lifted away from or is seated against the seat surface 22, a connection between the injection hole 8 and the nozzle chamber 19 is opened or closed to start or stop the fuel injection through the injection hole 8.

A rear end portion (upper end portion in FIG. 1) of the nozzle needle 9 forms a second slidable shaft portion 24, which is axially slidably supported by the tubular member 13.

The coil spring 11 is axially expandable and is received in the spring chamber 20 such that the coil spring 11 is held between the tubular member 13 and a shim 25 provided at a rear end of the slidable shaft portion 18. In this way, the coil spring 11 urges the nozzle needle 9 toward the axial distal end side (in the valve closing direction) and urged the tubular member 13 toward the axial rear end side to urge the tubular member 13 against the chip packing 6.

Therefore, a distal end side of an inner peripheral region of the tubular member 13 is closed by the second slidable shaft portion 24, and a rear end side of the inner peripheral region of the tubular member 13 is closed by the chip packing 6. When the high pressure fuel flows into or out of the closed inner peripheral region, which is closed in the above described manner, the closed inner peripheral region functions as the back pressure chamber 12.

That is, the chip packing 6 has an inlet flow passage 27 and an outlet flow passage 28. The inlet flow passage 27 is provided to supply the high pressure fuel into the back pressure chamber 12. The outlet flow passage 28 is provided to discharge the fuel form the back pressure chamber 12. A flow restriction 29 is formed in the inlet flow passage 27. Also, a flow restriction 30 is formed in the outlet flow passage 28. The injection nozzle 3 and the chip packing 6 are securely connected to the main body 2 such that the inlet flow passage 27 and the outlet flow passage 28 are both connected to the back pressure chamber 12.

Furthermore, the inlet flow passage 27 is formed such that the inlet flow passage 27 is branched from the high pressure flow passage 16 in the chip packing 6. The outlet flow passage 28 is formed such that the solenoid valve 5 can open or close a connection between the outlet flow passage 28 and a low pressure flow passage (not shown) of the main body 2.

Here, the low pressure flow passage is a fuel flow passage that conducts fuel of a low pressure, which is substantially lower than the fuel pressure of the high pressure flow passage 16. The high pressure fuel passes through various clearances and is thereby depressurized to the low pressure fuel, which is then conducted through the low pressure flow passage.

Therefore, when the state of the inlet flow and/or outlet flow of fuel relative to the back pressure chamber 12 through the inlet flow passage 27 and the outlet flow passage 28 is made variable in response to the operation of the solenoid valve 5, the fuel pressure (back pressure) of the back pressure chamber 12 is increased or decreased to drive the nozzle needle 9 in the valve closing direction or the valve opening direction.

The flow restrictions 29, 30 are provided to reliably reduce the back pressure by communicating between the outlet flow passage 28 and the low pressure flow passage through the valve opening of the solenoid valve 5. Furthermore, the flow restriction 30 is formed at a downstream end of the outlet flow passage 28 and opens to a rear end surface of the chip packing 6. An opening of the flow restriction 30 at the rear end surface of the chip packing 6 forms an output opening 32, through which the fuel of the back pressure chamber 12 is outputted.

Furthermore, the solenoid valve 5 has a known structure and functions as follows. Specifically, when a solenoid coil (not shown) of the solenoid valve 5 is energized, the output opening 32 is opened relative to the low pressure flow passage. In contrast, when the solenoid coil of the solenoid valve 5 is deenergized, the output opening 32 is closed relative to the low pressure flow passage.

With the above construction, when the output opening 32 is opened relative to the low pressure flow passage upon starting of the energization of the solenoid coil of the solenoid valve 5, the back pressure is reduced, and thereby a resultant force, which axially acts against the nozzle needle 9 in the valve opening direction, is increased. Therefore, the nozzle needle 9 is driven in the valve opening direction to open the connection between the injection hole 8 and the nozzle chamber 19, so that the fuel injection is started.

Furthermore, when the energization of the solenoid coil is stopped to close the output opening 32 relative to the low pressure flow passage, the back pressure is increased, and thereby a resultant force, which axially acts against the nozzle needle 9 in the valve closing direction, is increased. Therefore, the nozzle needle 9 is driven in the valve closing direction to close the connection between the injection hole 8 and the nozzle chamber 19, so that the fuel injection is stopped.

Figures 2A, 2B:
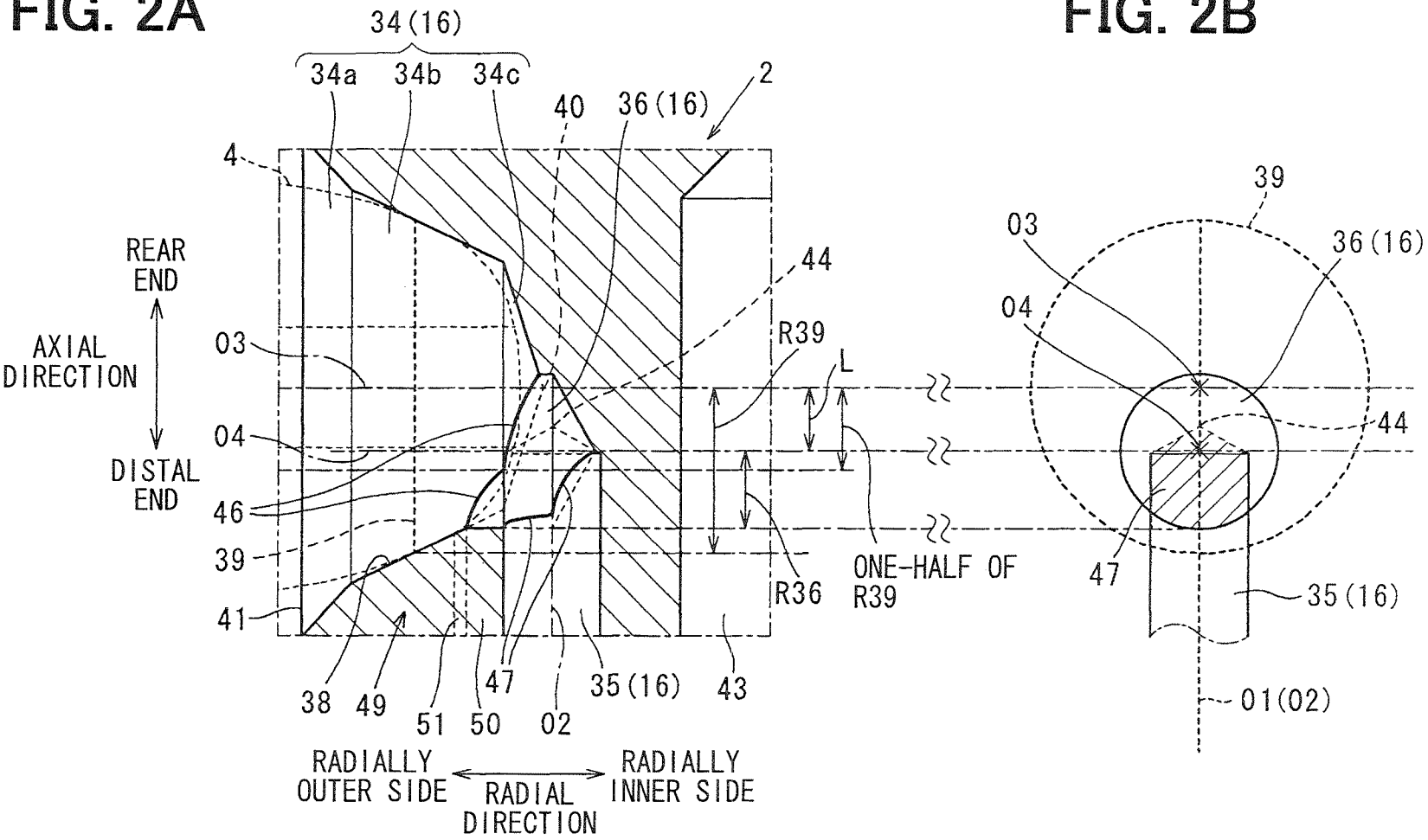
FIG. 2A is a cross-sectional view showing a main feature of the injector of the embodiment.
FIG. 2B is a diagram showing the main feature of the injector of the embodiment.
Figure 3:
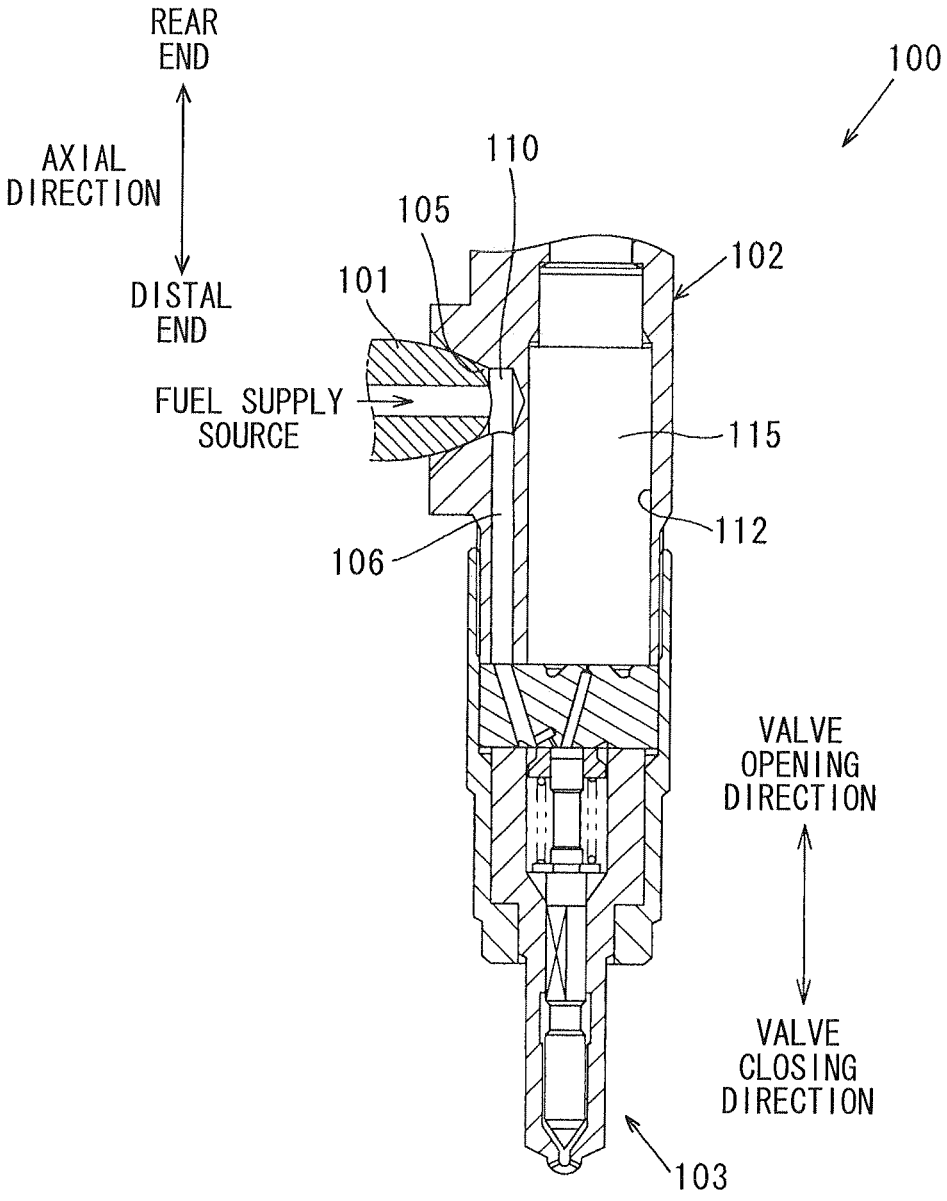
FIG. 3 RELATED ART
FIG. 3 is a diagram showing a previously proposed injector.
Figure 4:
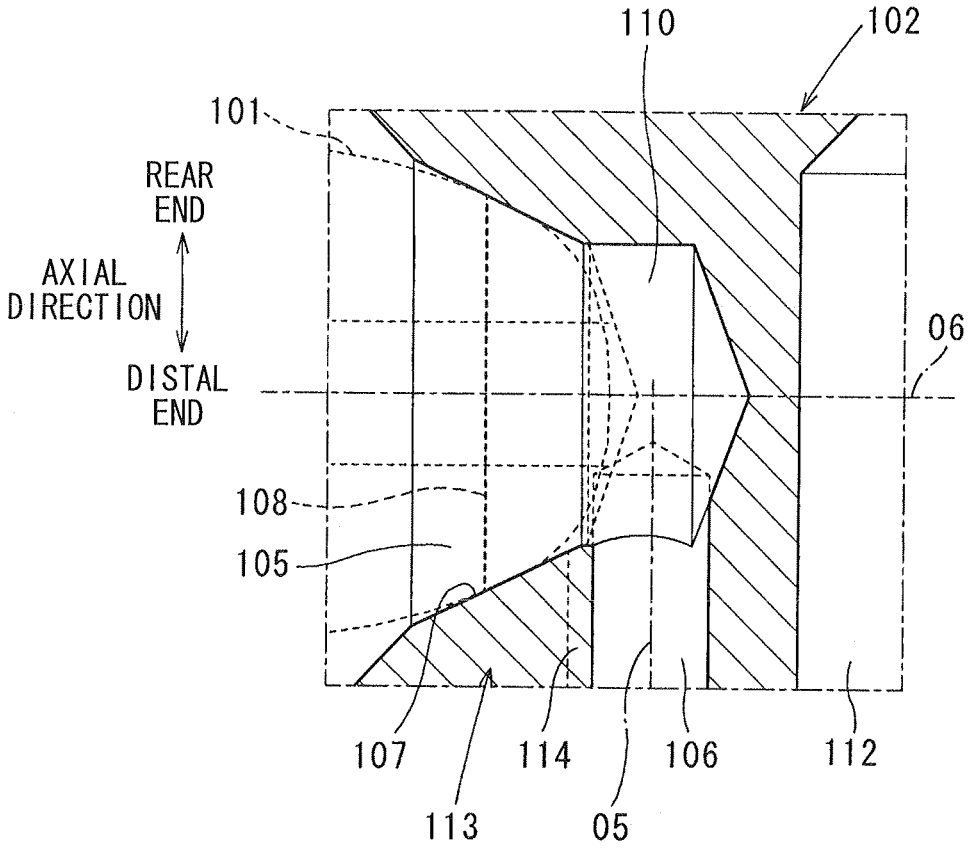
FIG. 4 RELATED ART
FIG. 4 is a diagram showing a main feature of the previously proposed injector.

Now, characteristic features of the injector 1 of the present embodiment will be described with reference to FIGS. 1 to 2B.

The inlet connector 4 is fixed to, for example, a cylinder head (not shown) of the internal combustion engine through screwing and is securely connected to, i.e., securely contacted against the lateral side of the main body 2 by the axial force generated by the screwing.

In this instance, the main body 2 includes a connector hole 34, an axial flow passage 35 and a communication hole 36. The connector hole 34 receives a distal end portion of the inlet connector 34. The axial flow passage 35 extends in parallel with the axial direction of the main body 2 and guides fuel, which is received from the inlet connector 34, to the injection nozzle 3. The communication hole 36 radially communicates between the connector hole 34 and the axial flow passage 35.

The connector hole 34 includes three hole sections 34*a*, 34*b*, 34*c*, which are conically tapered to have a progressively reducing diameter from a radially outer side (left side in FIG. 2A) toward a radially inner side (right side in FIG. 2A) of the connector hole 34 and are coaxial with each other. A hole axis O3 of the connector hole 34 is perpendicular to the axis O1 of the main body 2. In this instance, an angle of a slope of the taper of the hole section 34*b* is smaller than those of the hole sections 34*a*, 34*c*. The distal end portion of the inlet connector 4 forms a contact circle 39 to seal the high pressure fuel through circular contact of the distal end portion of the inlet connector 4 against a tapered hole surface 38, which forms the hole section 34*b*.

At this time, a center of the contact circle 39 coincides with the hole axis O3 of the connector hole 34. Furthermore, when the fuel is sealed by forming the contact circle 39, a fuel flow passage, which extends through the connector hole 34, the communication hole 36 and the axial flow passage 35, is formed. This fuel flow passage forms the high pressure flow passage 16 of the main body 2. The hole section 34*c* has a radial inner end 40 of the connector hole 34, and the hole section 34*a* has a radially outer side opening 41 of the connector hole 34.

The axial flow passage 35 is configured into a cylindrical tubular form and extends in parallel with the axial direction. A flow passage axis O2 of the axial flow passage 35 is perpendicular to the hole axis O3 of the connector hole 34. Furthermore, in view of the location of the space 43, which accommodates other devices, such as the solenoid valve 5, and the location of other fuel flow passages, such as the low pressure flow passage, the axial flow passage 35 is formed at a location, which is radially spaced from the axis O1 of the main body 2 and is radially adjacent to the radially outer side of the main body 2. An axial rear end (upper end in FIG. 2B) 44 of the axial flow passage 35 is placed adjacent to the radially inner end 40 of the connector hole 34.

The communication hole 36 includes the radially inner end 40 of the connector hole 34 and the axial rear end 44 of the axial flow passage 35 and is formed as a short cylindrical flow passage, which is short in the radial direction and communicates between the connector hole 34 and the axial flow passage 35. Therefore, an intersection 46 between the connector hole 34 and the communication hole 36 and an intersection 47 between the axial flow passage 35 and the communication hole 36 are concentrated in a narrow range, which is adjacent to the radially outer side.

A hole axis O4 of the communication hole 36 is placed at a location, which coincides with a translated location of the hole axis O3 of the connector hole 34 that is translated toward the axial distal end portion of the main body 2 in the axial direction of the main body 2. Therefore, the hole axis O4 of the communication hole 36 is parallel to the hole axis O3 of the connector hole 34 and is perpendicular to the flow passage axis O2 of the axial flow passage 35. Furthermore, a hole wall of an axial distal end portion of the communication hole 36 intersects with the hole surface 38 of the connector hole 34. That is, the portion of the hole surface 38, which is located at the axial distal end side and is close to the radial inner side, is cut by the communication hole 36.

Thereby, the high pressure flow passage 16, which extends through the connector hole 34, the communication hole 36 and the axial flow passage 35, forms a flow passage that is bent by 90 degrees. Furthermore, a projecting portion 49, which acutely projects toward the axial rear end side (upper side in FIG. 2A) due to the presence of the hole surface 38, is formed at an inner side area of this bent located on an inner side (lower left side in FIG. 2A) of the bent.

Furthermore, a layer portion 50 of the projecting portion 49, which has a constant width from the radial inner end (flow passage wall of the axial flow passage 35) to the radial outer side, has the reduced amount of projection toward the axial rear end due to the intersection between the connector hole 34 and the communication hole 36 (hereinafter, the layer portion 50 will be referred to as a projection amount reducing layer 50). A stress, which is caused by the axial force exerted by the screwing of the inlet connector 4, and a stress, which is caused by the pressure of the received fuel, are mainly dispersed at the projection amount reducing layer 50 and an adjacent boundary layer 51. The adjacent boundary layer 51 is connected to the radially outer side of the projection amount reducing layer 50 and has a constant width in the radial direction.

In this instance, a hole radius R36 of the communication hole 36 is smaller than a value that is obtained by subtracting an axial distance L, which is measured between the hole axis O3 of the connector hole 34 and the hole axis O4 of the communication hole 36, from a radius R39 of the contact circle 39.

In addition, the hole radius R36 of the communication hole 36 is set such that the intersection 47 between the axial flow passage 35 and the communication hole 36 does not form a flow restriction at the axial flow passage 35 and the communication hole 36. More specifically, the hole radius R36 is set such that an effective flow passage cross-sectional area at the intersection 47 is larger than a flow passage cross-sectional area of the axial flow passage 35.

Furthermore, the axial distance L is smaller than one half of the radius R39.

Now, advantages of the embodiment will be described.

The injector 1 of the present embodiment includes the inlet connector 4, which is securely connected to the lateral side of the main body 2 and forms the fuel receiving portion to supply the fuel to the main body 2. The main body 2 includes the connector hole 34, the axial flow passage 35 and the communication hole 36. The connector hole 34 receives the distal end portion of the inlet connector 4. The axial flow passage 35 extends in parallel with the axial direction of the main body 2 and guides the fuel, which is received from the inlet connector 4, to the injection nozzle 3. The communication hole 36 communicates between the connector hole 34 and the axial flow passage 35 in the radial direction of the main body 2.

The distal end portion of the inlet connector 4 forms the contact circle 39 to seal the fuel through circular contact of the distal end portion of the inlet connector 4 against a tapered hole surface 38, which forms the connector hole 34. The hole axis O4 of the communication hole 36 is placed at the location, which coincides with the translated location of the hole axis O3 of the connector hole 34 that is translated toward the axial distal end portion of the main body 2 in the axial direction of the main body 2.

In this way, with respect to the high pressure flow passage 16, which is bent by 90 degrees and extends through the connector hole 34, the communication hole 36 and the axial flow passage 35, the amount of projection of the projecting portion 49 at the inner side area of this bent, which is located on the inner side of the bent, is reduced. Thereby, a compressive strength at the connecting and intersecting structure of the connector hole 34, the axial flow passage 35 and the communication hole 36 can be increased.

Specifically, the hole axis O4 of the communication hole 36 is placed at the location, which coincides with the translated location of the hole axis O3 of the connector hole 34 that is translated toward the axial distal end portion of the main body 2 in the axial direction of the main body 2. In this way, a top of the radial inner end of the projecting portion 49 is cut away by the provision of the communication hole 36. Therefore, by reducing the amount of projection of the projecting portion 49, the concentration of the stress at the projecting portion 49 can be alleviated.

As a result, with respect to the injector 1, which receives the fuel through the inlet connector 4, it is possible to alleviate the concentration of the stress at the connecting and intersecting structure of the connector hole 34, the axial flow passage 35 and the communication hole 36 in the main body 2, and thereby it is possible to increase the compression strength of the connecting and intersecting structure.

Furthermore, the hole radius R36 of the communication hole 36 is smaller than the value that is obtained by subtracting the axial distance L, which is measured between the hole axis O3 of the connector hole 34 and the hole axis O4 of the communication hole 36, from the radius R39 of the contact circle 39.

In this way, it is possible to avoid the intersection of the communication hole 36 with the contact circle 39. Also, when the upper limit of the hole radius R36 is set, it is possible to limit endless increase of the flow passage wall surface area of the communication hole 36, and thereby it is possible to limit the pressure receiving surface area, which receives the fuel pressure.

In addition, the hole radius R36 of the communication hole 36 is set such that the intersection 47 between the axial flow passage 35 and the communication hole 36 does not form the flow restriction at the axial flow passage 35 and the communication hole 36.

In this way, the flow amount of fuel, which is set based on the axial flow passage 35, can be reliably provided.

Furthermore, the axial distance L, which is measured between the hole axis O3 of the connector hole 34 and the hole axis O4 of the communication hole 36, is smaller than one half of the radius R39 of the contact circle 39.

Thereby, the communication hole 36 can be provided such that the communication hole 36 does not intersect with the contact circle 39, and the intersection 47 does not form the flow restriction.

The structure of the injector 1 is not limited to the above embodiment and may be modified in various ways.

For example, in the injector 1 of the above embodiment, the back pressure is applied to the nozzle needle 9. Alternatively, for example, a command piston may be axially slidably supported in the main body 2 such that the command piston contacts a rear end of the nozzle needle 9. Furthermore, the back pressure chamber 12 may be formed on a rear end side of the command piston, and the back pressure may be applied to the nozzle needle 9 through the command piston.

Additional advantages and modifications will readily occur to those skilled in the art. The invention in its broader terms is therefore not limited to the specific details, representative apparatus, and illustrative examples shown and described.

What is claimed is:

1. An injector for an internal combustion engine, comprising:

a main body, which receives fuel from a fuel supply source;

an injection nozzle, which is securely connected to an axial distal end portion of the main body and injects the fuel upon receiving the fuel from the main body; and an inlet connector, which is securely connected to a lateral side of the main body and forms a fuel receiving portion to supply the fuel to the main body, wherein:

the main body includes:

a connector hole that receives a distal end portion of the inlet connector;

an axial flow passage that extends in parallel with an axial direction of the main body and guides the fuel, which is received from the inlet connector, to the injection nozzle; and a communication hole that communicates between the connector hole and the axial flow passage in a radial direction of the main body;

the distal end portion of the inlet connector forms a contact circle to seal the fuel through circular contact of the distal end portion of the inlet connector against a tapered hole surface, which forms the connector hole and directly connects with a portion of the communication hole; and a hole axis of the communication hole is placed at a location, which coincides with a translated location of a hole axis of the connector hole that is translated toward the axial distal end portion of the main body in the axial direction of the main body.

2. The injector according to claim 1, wherein a hole radius of the communication hole is smaller than a value, which is obtained by subtracting an axial distance between the hole axis of the connector hole and the hole axis of the communication hole from a radius of the contact circle.

3. The injector according to claim 1, wherein a hole radius of the communication hole is set such that an intersection between the axial flow passage and the communication hole does not form a flow restriction at the axial flow passage and the communication hole.

4. The injector according to claim 1, wherein an axial distance between the hole axis of the connector hole and the hole axis of the communication hole is smaller than one half of a radius of the contact circle.

5. The injector according to claim 1, wherein a downstream end of the communication hole is communicated only to the axial flow passage.

6. The injector according to claim 1, wherein an axis of the communication hole intersects with an axis of the axial flow passage generally at 90 degrees.

7. The injector according to claim 1, wherein the portion of the communication hole, which directly connects with the tapered hole surface, extends in a direction that is generally parallel to the hole axis of the connector hole and is generally perpendicular to a flow passage axis of the axial flow passage.

8. An injector for an internal combustion engine, comprising:

a main body, which receives fuel from a fuel supply source;

an injection nozzle, which is securely connected to an axial distal end portion of the main body and injects the fuel upon receiving the fuel from the main body; and an inlet connector, which is securely connected to a lateral side of the main body and forms a fuel receiving portion to supply the fuel to the main body, wherein:

the main body includes:

a connector hole that receives a distal end portion of the inlet connector;

an axial flow passage that extends in parallel with an axial direction of the main body and guides the fuel, which is received from the inlet connector, to the injection nozzle; and a communication hole that communicates between the connector hole and the axial flow passage in a radial direction of the main body;

the distal end portion of the inlet connector forms a contact circle to seal the fuel through circular contact of the distal end portion of the inlet connector against a tapered hole surface, which forms the connector hole and transitions to a portion of the communication hole; and a hole axis of the communication hole is placed at a location, which coincides with a translated location of a hole axis of the connector hole that is translated toward the axial distal end portion of the main body in the axial direction of the main body.

9. The injector according to claim 8, wherein a hole radius of the communication hole is smaller than a value, which is obtained by subtracting an axial distance between the hole axis of the connector hole and the hole axis of the communication hole from a radius of the contact circle.

10. The injector according to claim 8, wherein a hole radius of the communication hole is set such that an intersection between the axial flow passage and the communication hole does not form a flow restriction at the axial flow passage and the communication hole.

11. The injector according to claim 8, wherein an axial distance between the hole axis of the connector hole and the hole axis of the communication hole is smaller than one half of a radius of the contact circle.

12. The injector according to claim 8, wherein a downstream end of the communication hole is communicated only to the axial flow passage.

13. The injector according to claim 8, wherein an axis of the communication hole intersects with an axis of the axial flow passage generally at 90 degrees.

14. The injector according to claim 8, wherein the portion of the communication hole, which directly connects with the tapered hole surface, extends in a direction that is generally parallel to the hole axis of the connector hole and is generally perpendicular to a flow passage axis of the axial flow passage.

* * * * *